US011470950B2

(12) United States Patent
Hawkins

(10) Patent No.: US 11,470,950 B2
(45) Date of Patent: Oct. 18, 2022

(54) TACTICAL BELT OR BELT ACCESSORY

(71) Applicant: David Robert L. Hawkins, St. Thomas (CA)

(72) Inventor: David Robert L. Hawkins, St. Thomas (CA)

( * ) Notice: Subject to any disclaimer, the term of this patent is extended or adjusted under 35 U.S.C. 154(b) by 0 days.

(21) Appl. No.: 16/563,289

(22) Filed: Sep. 6, 2019

(65) Prior Publication Data

US 2020/0077776 A1 Mar. 12, 2020

Related U.S. Application Data

(60) Provisional application No. 62/728,520, filed on Sep. 7, 2018.

(51) Int. Cl.

| | |
|---|---|
| ***A45F 5/02*** | (2006.01) |
| ***A41F 9/00*** | (2006.01) |
| ***A44B 11/20*** | (2006.01) |

(52) U.S. Cl.

CPC ..... *A45F 5/021* (2013.01); *A41F 9/002* (2013.01); *A44B 11/20* (2013.01)

(58) Field of Classification Search

CPC ..... A41F 9/002; A44B 11/20; A45F 5/021; A45F 2003/144; A45F 3/06; A45F 5/02; A45F 9/002; F41C 33/041; F41C 33/043; F41C 33/046

USPC ..... 224/665, 660, 672, 650, 249, 651

See application file for complete search history.

(56) References Cited

U.S. PATENT DOCUMENTS

| | | | | |
|---|---|---|---|---|
| 6,547,118 | B2 * | 4/2003 | Beletsky | A45F 5/00 224/661 |
| 8,011,545 | B2 * | 9/2011 | Murdoch | B25H 3/00 224/672 |
| 9,173,436 | B2 * | 11/2015 | Crye | A41D 13/0007 |
| 2008/0210729 | A1 * | 9/2008 | Pittman | A45F 3/14 224/662 |
| 2009/0014602 | A1 * | 1/2009 | Frost | B60R 7/08 248/100 |
| 2009/0235431 | A1 * | 9/2009 | Bevley | A41F 9/00 2/227 |
| 2013/0126566 | A1 * | 5/2013 | Seuk | A45F 5/00 224/223 |
| 2018/0049493 | A1 * | 2/2018 | Graves | A41D 27/08 |

* cited by examiner

*Primary Examiner* — Nathan J Newhouse
*Assistant Examiner* — Matthew T Theis

(57) ABSTRACT

A tactical belt or belt accessory system comprising an integral single layer strap having a two opposite ends, a top edge and a bottom edge, and at least one row of a plurality of openings distributed lengthwise along the strap between the two opposite ends, the openings being separated by links that are an integral part of the single layer strap, the openings configured to facilitate attachment of MOLLE-compatible accessories along a horizontal axis or a vertical axis without skipping any of the links.

10 Claims, 8 Drawing Sheets

TACTICAL BELT OR BELT ACCESSORY

CROSS REFERENCE TO RELATED APPLICATIONS

This application claims the benefit of Provisional Patent Application Ser. No. 62/278,520, filed Sep. 7, 2018, the contents of which are hereby incorporated by reference into the present disclosure.

1. FIELD OF THE INVENTION

The present invention relates to tactical belt or tactical belt accessory system.

2. BACKGROUND OF INVENTION

In tactical situations, military or law enforcement personnel, often depend on personal mobility to transport mission specific equipment. Typically, at least a portion of this mission specific equipment is carried using a belt mounted on the waist of an individual. The type of equipment may vary significantly depending on the specific mission or tactical situation. Many other conventional belts, while accounting for load carriage, fail to provide the versatility of carrying different types of interchangeable equipment. It is with these observations in mind, among others, that various aspects of the present disclosure were conceived and developed (see WO/2017/007773).

Current Modular Lightweight Load-carrying Equipment (MOLLE) belts are of nylon construction and require layer and or stitching to attach MOLLE pouches. It is common for tactical belts which are MOLLE capable to be constructed of nylon, requiring additional stitching to attach additional MOLLE mounting points. The nylon has reduced strength and rigidity when wet, is heavy and degrades in wet environments or with constant weights applied to it (e.g. pistol holster and pistol). Current MOLLE capable nylon belts only allow for MOLLE attachments in the vertical position and when a belt is degraded, the entire belt requires replacement.

WO/2017/007773 describes a tactical belt having a base belt made of nylon and at least one row of webbing attached to an outer surface of the base belt, also made of nylon. The webbing may be MOLLE webbing adapted to carry mission specific equipment. The webbing extends along a length of the base belt and can only carry equipment in the vertical position.

WO/2016/022838 describes an attachment system having a plurality of hexagonal openings formed in the attachment system and arranged in a repeating hexagonal pattern. The hexagonal openings are arranged in a pattern corresponding to a hexagon so that an attachment member for a MOLLE-compatible accessory may be passed through one or more of the openings so as to attach the accessory in a variety of different directions. This document does not teach a single row of openings but rather a plurality of rows to form a hexagon pattern. Since a hexagon pattern is an essential element of this disclosure, this document fails to mention belts as an example of a load bearing platform onto which the hexagonal system can be attached.

To fully secure a piece of MOLLE-compatible equipment or gear, the attachment member of the MOLLE-compatible equipment/gear must go through at least two links without skipping any links between the openings. With the system of WO/2016/022838 as illustrated in FIG. 2, one can fully secure a MOLLE-compatible equipment horizontally or diagonally, but not vertically because links between the hexagonal openings would be skipped.

3. SUMMARY OF THE INVENTION

The present invention relates to a tactical belt or belt accessory system that has the elements of claim 1.

In one embodiment, the present invention is a tactical belt comprising an integral single layer strap having a two opposite ends, a top edge and a bottom edge, and a plurality of cut-outs distributed lengthwise along the strap between the two opposite ends.

In one embodiment of the tactical belt of the present invention, the tactical belt comprises an integral single layer strap having a two opposite ends, a top edge and a bottom edge, and at least one row of a plurality of openings distributed lengthwise along the strap between the two opposite ends, the openings being separated by links that are an integral part of the single layer strap, the openings configured to facilitate attachment of MOLLE-compatible accessories along a horizontal axis that extends lengthwise through the two opposite ends or along a vertical axis without skipping any of the links between the openings to which the MOLLE-compatible accessory is attached to.

In another embodiment of the present invention, the tactical belt further comprises at least one attachment point below a main horizontal plane of the strap and attachment points at either of the opposite ends of the strap.

In another embodiment of the present invention, the tactical belt further comprises a belt weaved through the cut-outs.

In another embodiment of the present invention, the single layer strap is configured to remain rigged in a vertical plane, flexible in a horizontal plane, chemically resistant and impervious to salt water.

In another embodiment of the present invention, the single layer strap is composed of a thermoplastic composite.

In another embodiment of the present invention, the composite of the tactical belt or belt accessory system is Tegris®.

In another embodiment of the present invention the tactical belt further comprises one or more attachments and leg straps connected to the tactical belt by the one or more attachments.

In another embodiment of the present invention, the tactical belt comprises two or more rows of the plurality of openings.

4. BRIEF DESCRIPTION OF THE FIGURES

The present invention will become more fully understood from the detailed description given herein and from the accompanying drawings, which are given by way of illustration only and do not limit the intended scope of the invention.

FIG. 11 is a graphic illustrating a front perspective view of a tactical belt accessory system an embodiment having weaving straps or webbing through.

5. DETAILED DESCRIPTION OF THE INVENTION

5.1 Overview

Figure 1:
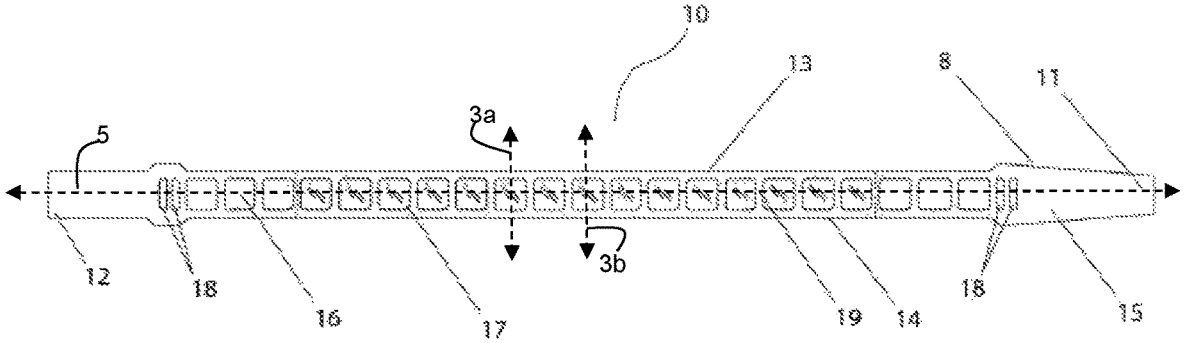
FIG. 1 is a graph illustrating a front view of a tactical belt accessory system in accordance with one embodiment of the present invention.

The present invention addresses a multi-functional belt or belt accessory to which Modular Lightweight Load-carrying Equipment (MOLLE), a standard for NATO armed forces, can be attached in a vertical or horizontal configuration to cut-outs arranged along the belt accessory without stitching typically required for MOLLE attachment points, while maintaining freedom of movement of the wearer and the inner belt (if used). The belt accessory of the present invention is made of Tegris® (see http://tegris.milliken.com/en-us/technology/Documents/Tegris %20Overview %202015.pdf, this document, including the properties of Tegris®, are incorporated herein by reference), a thermoplastic composite that in the single layer cut for of the belt remains rigged in the vertical plane but flexible in the horizontal plane. The material is naturally chemically resistant and impervious to salt water and the degradation seen in typical nylon belts. Any belt or strap of about 2.54 cm. (1 inch) can be weaved through the cut-outs to allow customization for different uses, quickly and without changing MOLLE pouches attached.

5.2 Definitions

Unless defined otherwise, all technical and scientific terms used herein have the same meaning as commonly understood by one of ordinary skill in the art to which this invention belongs. Also, unless indicated otherwise, except within the claims, the use of "or" includes "and" and vice versa. Non-limiting terms are not to be construed as limiting unless expressly stated or the context clearly indicates otherwise (for example "including", "having" and "comprising" typically indicate "including without limitation"). Singular forms included in the claims such as "a", "an" and "the" include the plural reference unless expressly stated otherwise. All relevant references, including patents, patent applications; government publications, government regulations, and academic literature, and including the priority document, are hereinafter detailed and incorporated by reference in their entireties.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

As used herein, the term "substantially" includes exactly the term it modifies and slight variations therefrom.

5.3 Tactical Belt or Belt Accessory System

This invention provides for a tactical belt or belt accessory system with multiple cut-outs lengthwise along the belt provide a vertical rigidity, increased rapid customization via MOLLE pouches and greater resistance to deterioration without requiring additional layers, stitching or stiffeners. The belt of the present invention provides an ability to allow a user to customize loadout and belt attachments quickly and easily to suit intended use by user, as shown in the figures.

With reference to FIGS. 1 to 14, a tactical belt/belt accessory 10 according to one embodiment of the present invention has a first end 11, a second end 12, a top edge 13, a bottom edge 14, a front face 15 and an opposite back face 71.

The tactical belt/belt accessory 10 may be made as an integral unity having only one layer of material 8. The material being a flexible material that is chemical resistant and waterproof. Example of this material is a polypropylene thermoplastic sold under the brand Tegris®. The tactical belt/belt accessory of the present invention is lightweight (about 42 gm. for size small).

The tactical belt accessory system 10 includes a single row of a plurality of (i.e. more than one) openings or cut outs 16 separated by links 19. The openings 16 are arranged along the tactical belt accessory system 10 from the first end 11 to the second end 12 of the accessory system along horizontal axis 5. In one embodiment, the openings 16 are polygonal, including square and rectangular. Double arrow 5 in FIG. 1 indicates the horizontal axis that runs lengthwise connecting ends 11 and 12 and through all of the openings 16. Arrows 3*a,b* in FIG. 1 are examples of vertical axes, which are perpendicular to the horizontal axis 5. Each opening 16 includes its own vertical axis.

In one embodiment, not shown in the figures, the tactical belt accessory system of the present invention may include more than one row of openings, each row being arranged lengthwise between the first and send ends of the tactical belt accessory system. The openings in one row being aligned with the openings in the other rows.

Figure 7:
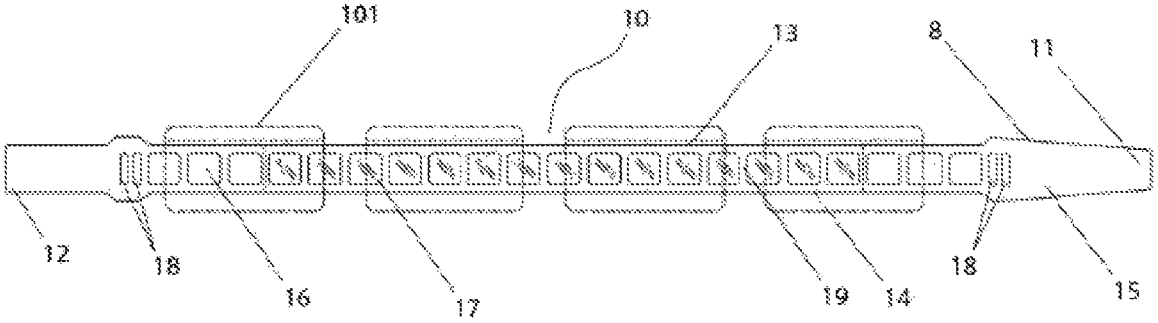
FIG. 7 is a graphic of a front view of the tactical belt accessory system in accordance to one embodiment of the present invention showing fully secured attachment of a MOLLE-compatible equipment in a horizontal position in accordance to one embodiment of the present invention.
Figure 8:
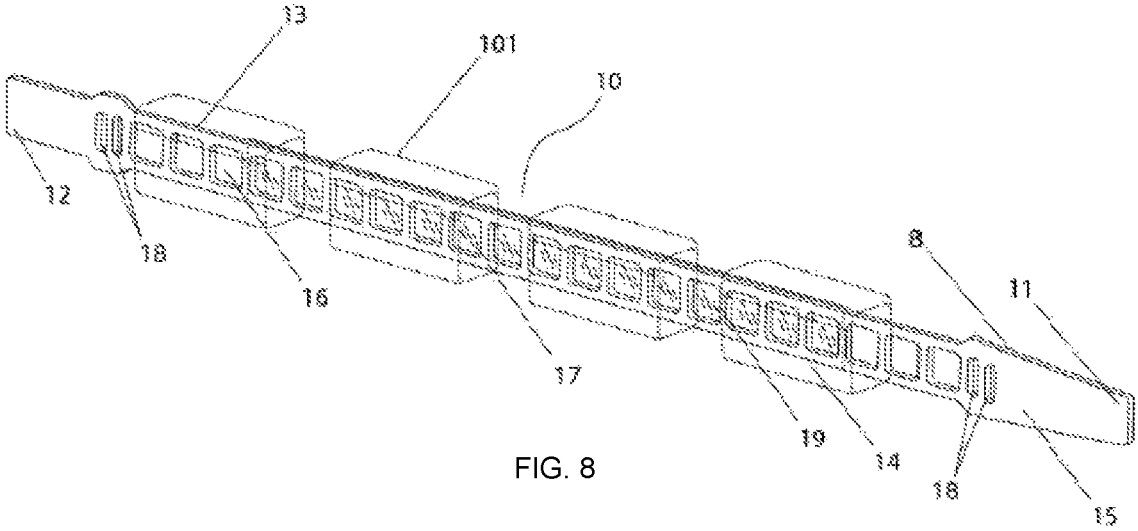
FIG. 8 is a graphic of a front perspective view of the tactical belt accessory system in accordance to one embodiment of the present invention showing fully secured attachment of a MOLLE-compatible equipment in a horizontal position in accordance to one embodiment of the present invention.

As illustrated in FIGS. 7 and 8, MOLLE-compatible accessories 101 may be secured along the horizontal axis that extends lengthwise through the two opposite ends or they may be secured along vertical axis without skipping any of the links 19 between the openings 16.

The front face 15 of the tactical belt accessory system 10 can be lined with another suitable material, such as a fabric. The fabric may be fixed to the front face 15 of the system 10. The suitable material may include patterns or graphics such as camouflage patterns.

Figure 2:
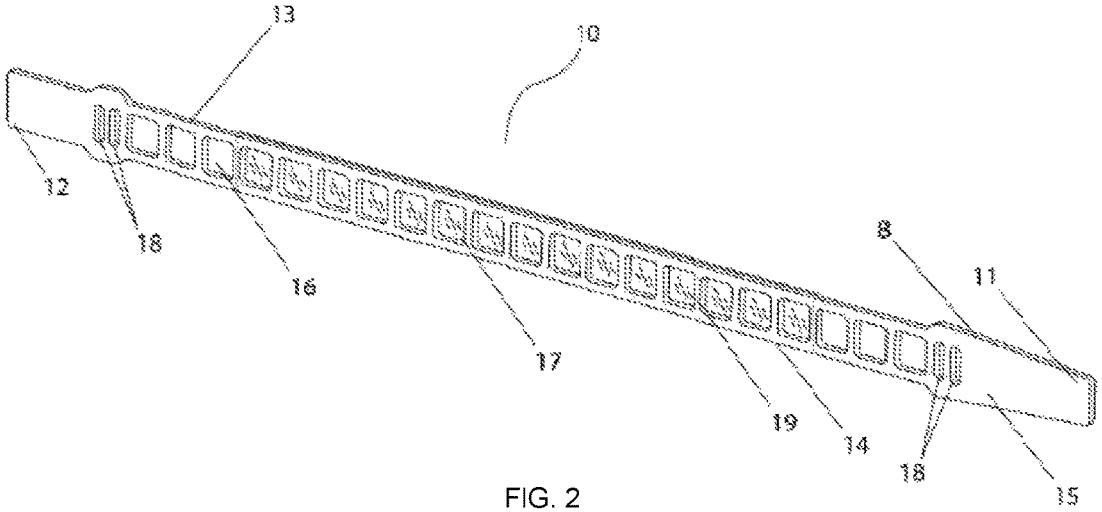
FIG. 2 is a graph illustrating a perspective view from the front of a tactical belt accessory system in accordance with one embodiment of the present invention.
Figure 3:
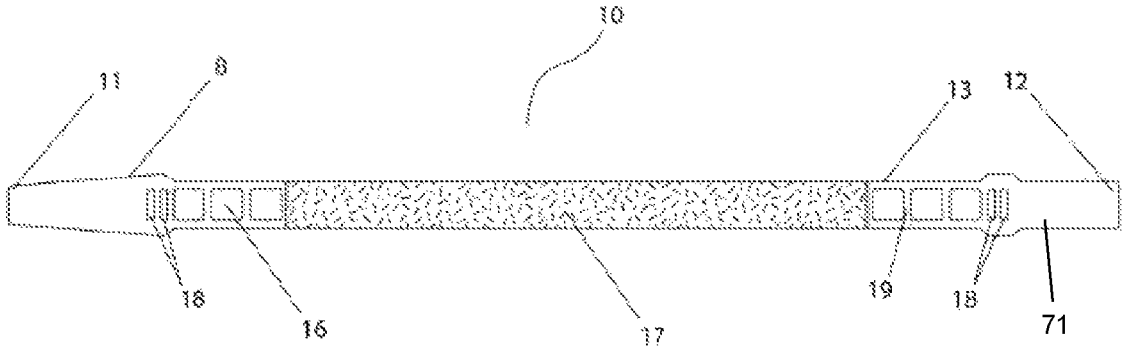
FIG. 3 is a graph illustrating a back view of a tactical belt accessory system in accordance with one embodiment of the present invention.
Figure 4:
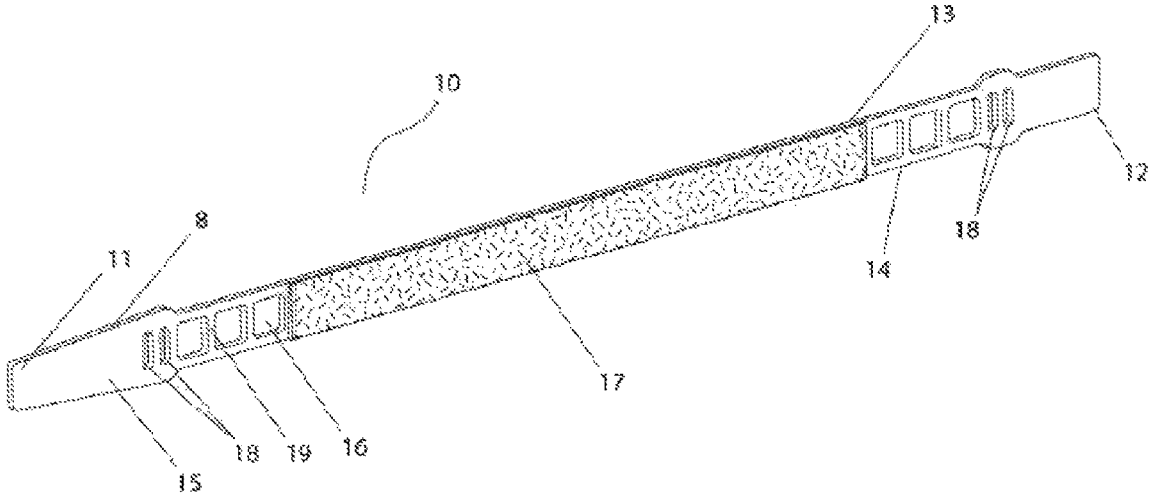
FIG. 4 is a back perspective view of a tactical belt accessory system according to an embodiment of the present invention.
Figure 5:
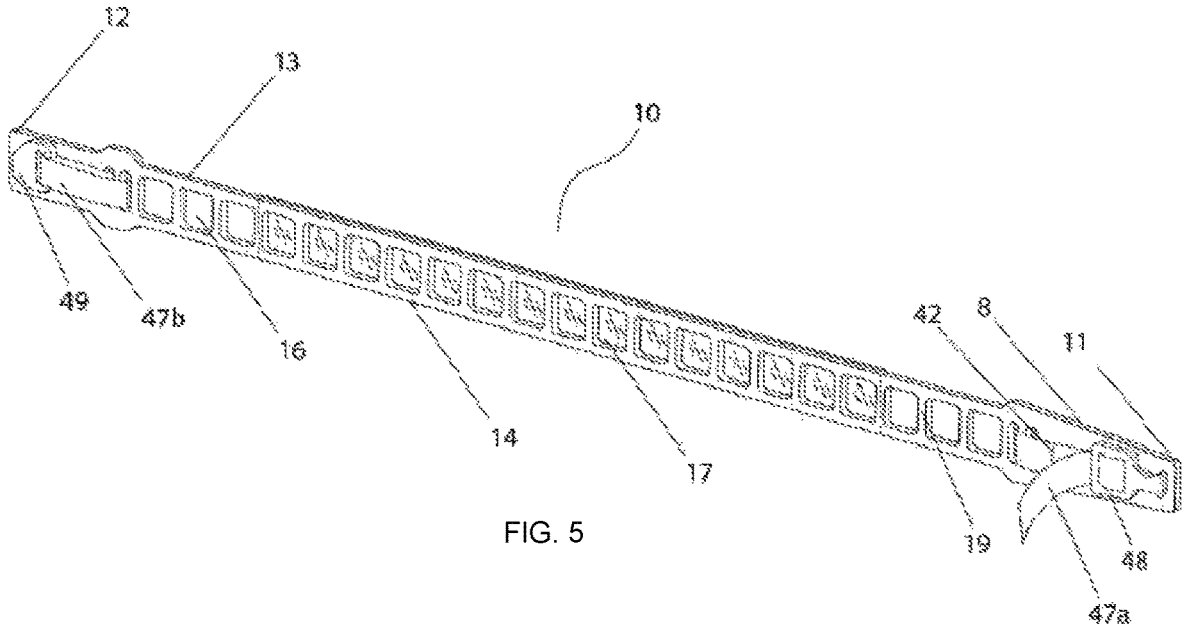
FIG. 5 is a graphic illustrating a front perspective view of a tactical belt accessory system according to one embodiment of the present invention.

In one embodiment, a second strap 17 shown in FIGS. 3 and 4 can be attached to the back face 71 by stitches or other connectors, such as loops and hooks (Velcro®) or both stitches and connectors. The second strap 17 can be seen through the openings 16 as illustrated in FIGS. 1, 2 and 5.

Figure 11:
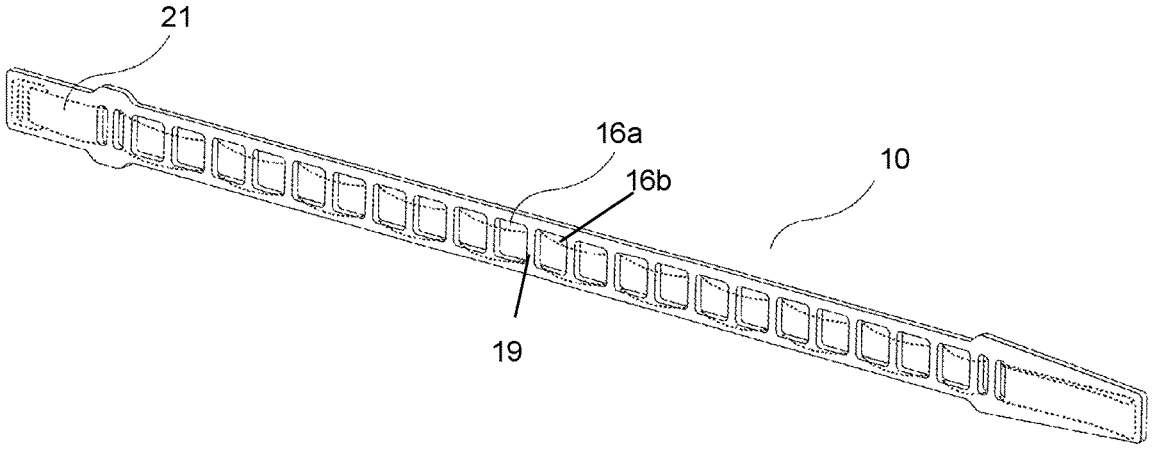

As shown in the FIG. 11, the openings 16 may be configured to receive a belt, webbing or strap 21, such as a tactical belt, laced through or below the openings 16 of the system 10 as it will be described below. The belt 21 may be a 1 inch (2.54 cm.) belt woven through the cut-outs to give additional customization to an individual. In this case, the tactical belt/belt accessory of the present invention functions as a belt accessory, providing the aforementioned benefits. In one embodiment, illustrated in FIG. 11, the belt 21 can go through a first opening 16*a* up and around the link 19 between the first opening 16*a* and the immediate neighboring second opening 16*b* and back down through the second opening 16*b* where it can be weaved through the two layers 17 of the belt. In another embodiment, the belt can be weaved through the two layers (i.e. the Tegris® layer 8 and the fabric layer 17) on the middle like a sandwich still allowing free movement of the webbing or strap. That is the strap or webbing 21 can be just pushed between the Tegris® layer 8 and the fabric layer 17.

Figure 6:
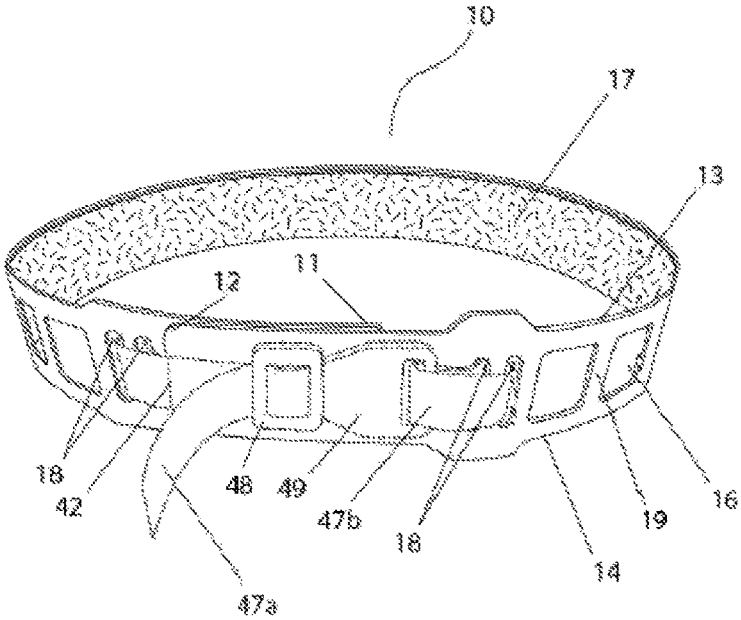
FIG. 6 is a graphic illustrating the tactical belt accessory system in accordance with another embodiment of the present invention with a strap or webbing to secure fast connecting buckle, in accordance to one embodiment of the present invention.

The tactical belt/belt accessory 10 of the present invention may include cut outs or opening means 18 to receive a fastener such as a buckle. Fasteners 48, 49 can be attached, coupled or linked to both ends 11, 12 of the tactical belt/belt accessory of the present invention to attach around an individual's waist. In this case, the tactical belt/belt accessory system is functioning as a belt. Opening means 18, which in the embodiment shown in FIG. 1 are four openings 18, two at each end of the tactical belt 10, allows the user to use straps or webbing 47*a,b* he or she chooses to go through the two openings 18 on each end 11, 12 and stitching 42 or tri glide attaching the straps together through any buckle or fastener system 48, 49 the user may choose. FIGS. 5 and 6 show a strap or webbing 47*a,b* that can be used to secure fast connecting buckle parts 48, 49.

Figure 13:
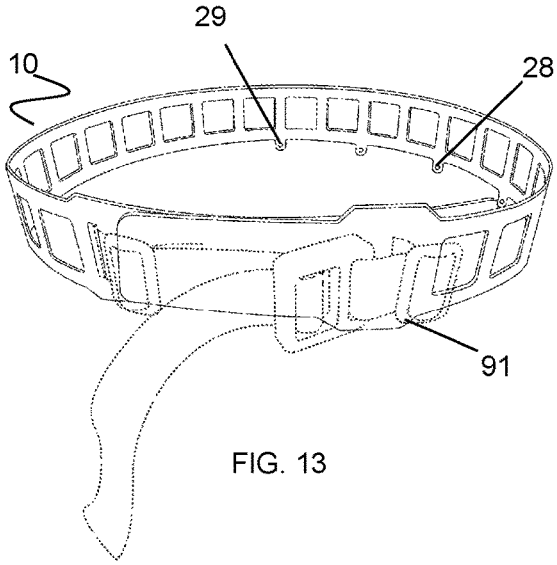
FIG. 13 is a graph illustrating the tactical belt accessory system in accordance to one embodiment showing tri glide belt adjustments.

Referring to FIG. 13, the tactical belt/belt accessory 10 of the present invention may include tri glide belt adjustments 91.

Figure 12:
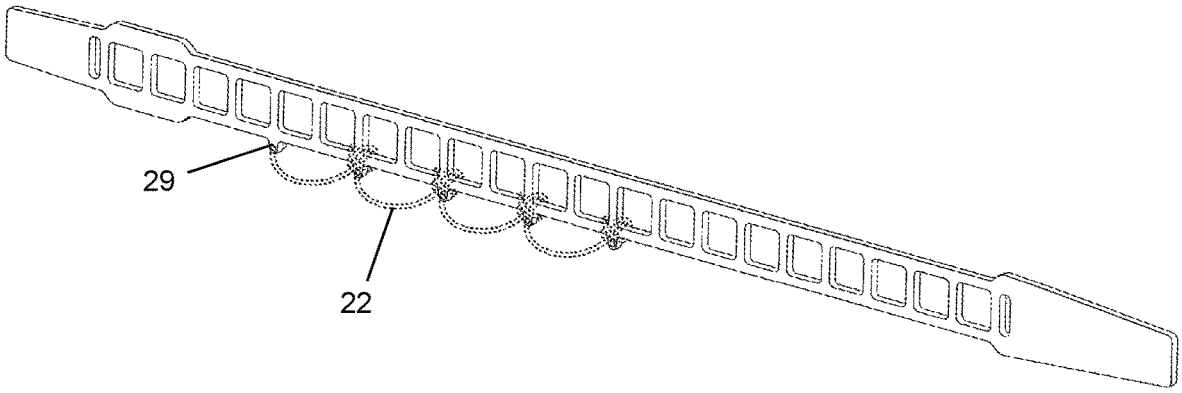
FIG. 12 is a graphic illustrating a tactical belt accessory system in accordance with one embodiment of the present invention.

In one embodiment, illustrated in FIGS. 12 and 13, at least one of the top or bottom edges of the belt 10 can include at least one extension or protrusion 29 having a hole 28. Holes 28 may be used to receive cords 22 for yet another layer of attachments. These holes 28 allow a user to attach cord 22 of their choosing to be weaved through and serve as placements or attachment points for lanyards, carabineers or accessories.

The distance between the bottom and top edges 13, 14 may be about 1.7 inches (4.3 cm.). The openings 16, in one embodiment, may be substantially square having sides of about one (1) inch (2.54 centimeters) each. The links 19 between the openings 16 may be about 0.35 inches (0.89 centimeters).

Figure 14:
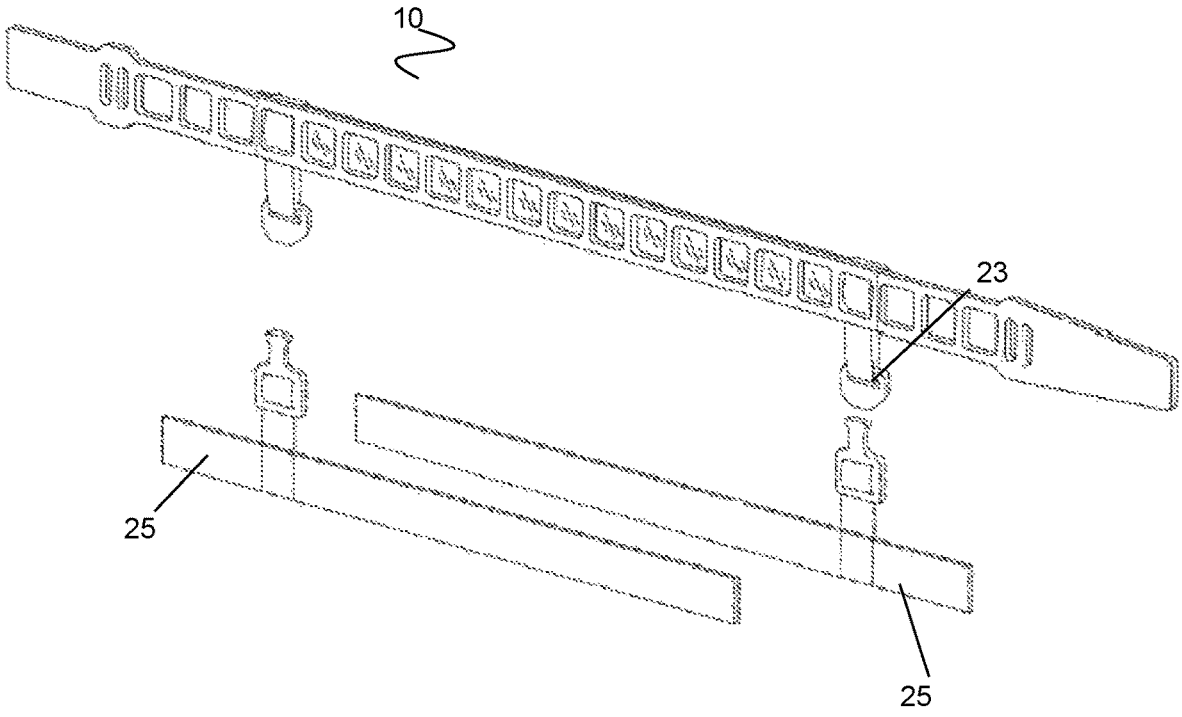
FIG. 14 is a photograph illustrating a tactical belt accessory system in accordance with one embodiment of the present invention with attachments for leg straps.

Illustrated in FIG. 14 are one or more leg straps 25 that can be connected to corresponding one or more attachments 23 in the tactical belt accessory system 10. The leg straps themselves, in one embodiment, may include a plurality of openings just like the openings 16 in the tactical belt accessory system 10.

Preferred practice of the belt of the present invention include:

a. Tactical scenarios such as: policy, military, security and so forth.
b. Environments such as: Ocean, river, lake, etc. including swift water, deserts, arid, urban, aerial rope work and so forth.
c. Recreational scenarios such as: Competitive shooting, Hiking, Wargames (e.g. paintball) and so forth.

The belt/belt accessory of the present invention may be used independently or in conjunction with the MOLLE system and or inner belt.

Advantages of the belt of the present invention include: 1. No stitching required to create MOLLE attachment points. 2. Remains rigged in the vertical plane, requiring no stiffener. 3. Lightweight (42 g for size small) due to single layer Tegris® material compared to layered nylon of the prior art. 4. Retains strength when wet, but flexible around the users waist. Regular belts break down over time and become floppy and non-rigid because of their materials such a as leather or nylon or poly webbing/straps. Water and chemicals and environment speed up the wear on these types of materials causing the user to have to replace them. 5. No water absorption. 6. Chemically and salt water resistant. 7. Allows for use of a belt weaved through cut-outs for customization. 8. Allows users to quickly change inner belt to suit use without re-rigging MOLLE pouches. 9. Ability to interchange multiple fastener depending on use of user. 10. MOLLE pouches can be fastened both vertically and horizontally. 11. When layered can provide ballistic protection properties. 12. Ability to add ripstop camo tape. 13. To be used around waist with MOLLE pouches attached to proper attachment points. 14. Can be used in environments down to −40 Celsius. 15. One can secure any pouch with only one MOLLE attachment on a single pouch.

Figure 9:
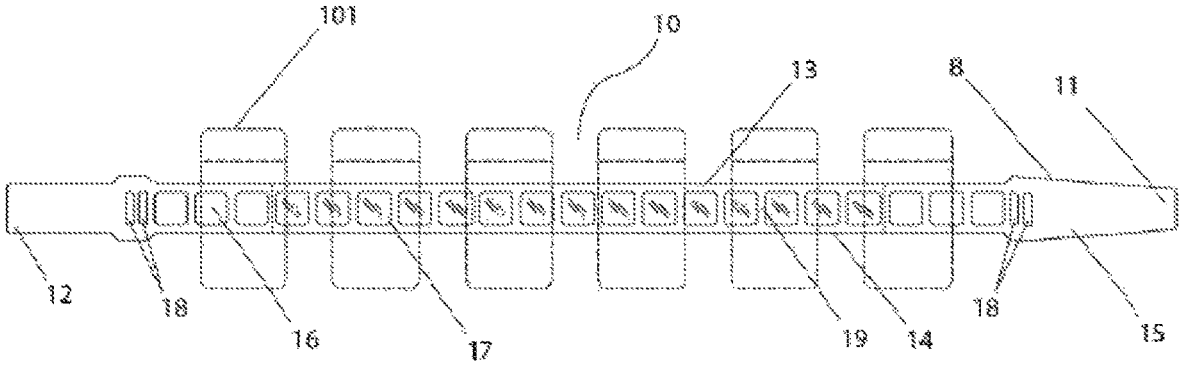
FIG. 9 is a graphic of a front view of the tactical belt accessory system in accordance to one embodiment of the present invention showing fully secured attachment of a MOLLE-compatible equipment in a vertical position in accordance to one embodiment of the present invention.
Figure 10:
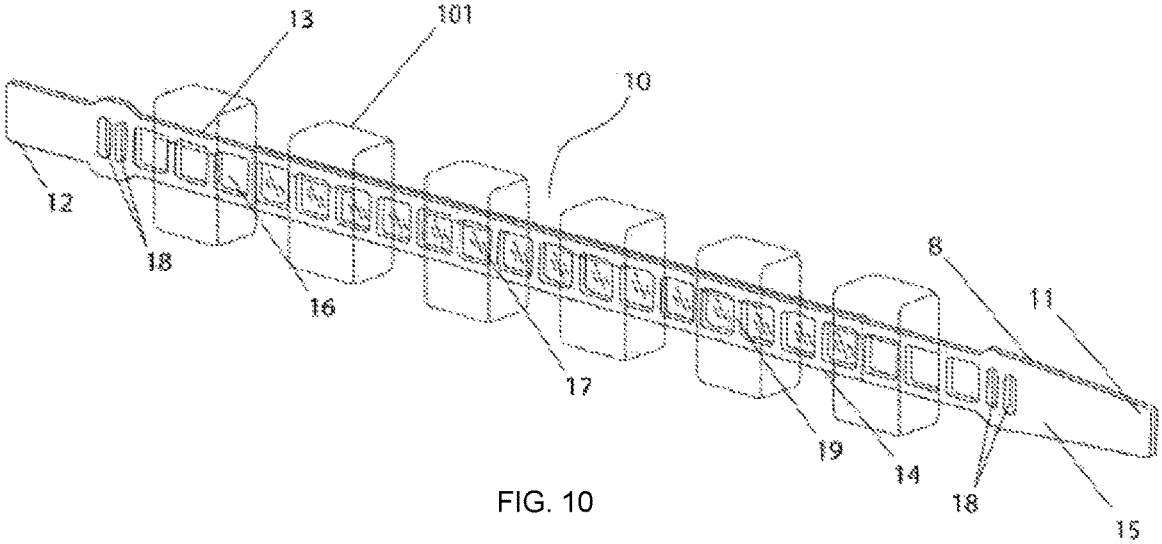
FIG. 10 is a graphic of a front perspective view of the tactical belt accessory system in accordance to one embodiment of the present invention showing fully secured attachment of a MOLLE-compatible equipment in a vertical position in accordance to one embodiment of the present invention.
Figure 15:
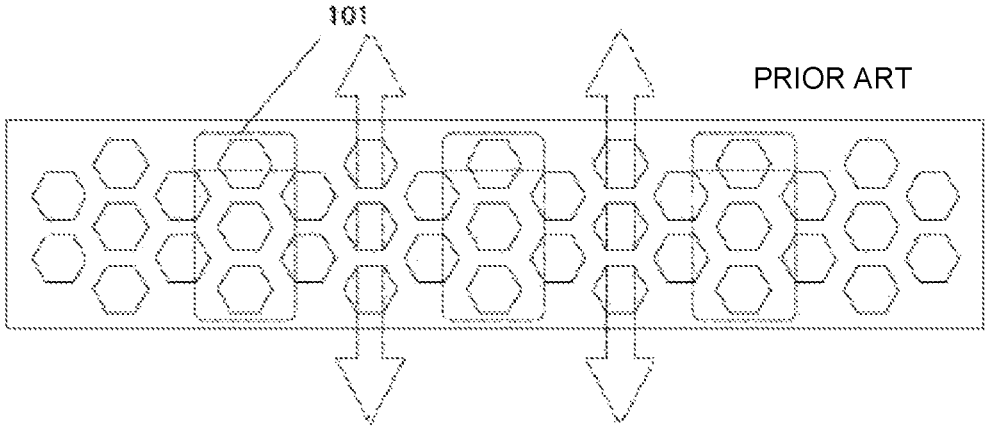
FIGS. 15, 16 and 17 are a graphics illustrating examples of orientations at which equipment can be mounted to the hexagonal system of the prior art.
Figure 16:
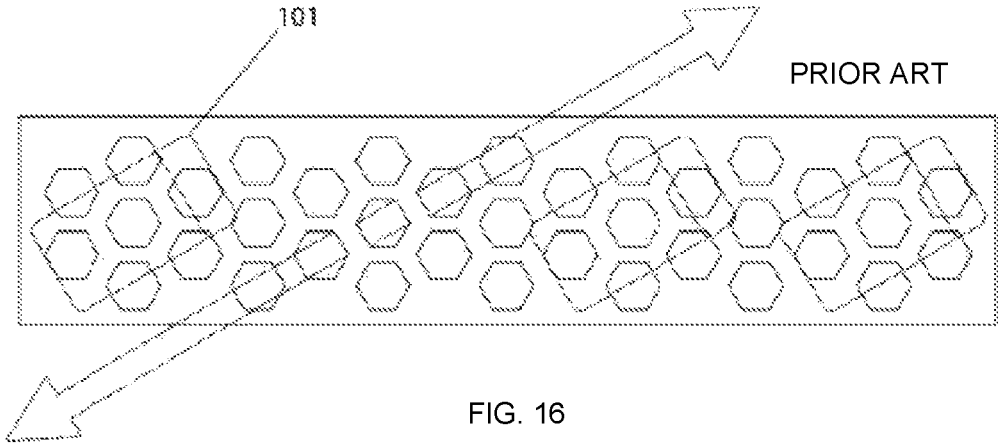
Figure 17:
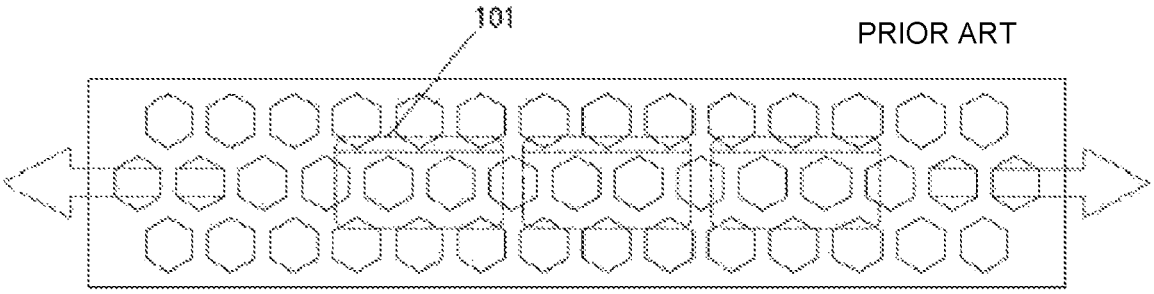

With reference to FIGS. 15 to 17, the belt/belt accessory of the present invention is superior and have many advantages over to the hexagonal pattern solution described in WO2016022838 ("WO838") due to the following:

a. A MOLLE-compatible pouch can be fully secured with only one MOLLE attachment to the system of the present invention vs the hexagonal openings of WO838. As previously explained, the hexagonal openings of WO838 only allows for fully secured items at a vertical orientation or an angle aligning with the hex pattern (FIG. 6-8 of WO838). A new attachment belt is required if a different orientation is required. For example, the system of FIGS. 15 and 17 allow to fully secure a MOLLE attachment only diagonally and vertically. As it can be seen in FIG. 9 of WO838, attachment links are skipped when securing a MOLLE attachment horizontally. The system of the present invention, on the other hand, allows to fully secure vertical, horizontal utilizing all MOLLE-attachment points on the pouch without leaving attachments points unused as seen in FIG. 9 of WO838. FIGS. 8 and 10 illustrates an example in which no link 19 between openings 16 is skipped, i.e. fully securing the equipment 101 to the belt system 10. If a link 19 is skipped then the equipment, although attached, is not fully secured to the belt system. Skipping a link 19 would compromise strength and rigidity and creates a gap which could snag and put the user of the device at risk.

b. Allowing different sized pouches to be attached without reducing stability. Typical MOLLE attachments require straps on the pouches that a belt weaved through the MOLLE hexagon are attached to. The belt must skip weaves through the hexagonal pattern of WO283 depending on the size of the pouch. Different MOLLE hexagonal patterns are required for different sized pouches to maintain stability and remain secure. The belt/bel accessory system of the present invention can be used for any traditionally size MOLLE pouch without changing the belt and allows for a variety of sized pouches on the same belt.

c. The tactical belt accessory system of the present invention maintains a rectangular opening for a belt to be weaved through reducing wear and tear on the belt. A typical MOLLE hex is angled due to the hex shape causing increase wear and tear on the top and bottom of the belt where it contacts the hexes vertices. Depending on the angle a pouch is mounted, the hex system can also cause improper mounting unlike the tactical belt accessory system which allows for multiple orientations while maintaining a secure attachment.

d. The tactical belt accessory system allows for the first three crucial MOLLE points to be as close as possible to keep the pouch secure and stable. As these points move away, a gap develops compromising the locking nature of a MOLLE attachment.

e. Being able to be used without the traditional nylon material, allowing the belt to maintain rigidity in wet environments due to its inability to absorb water.

f. Its resistance to chemical and water degradation, improving useful life and increase performance during use. The strap remains rigged in a vertical plane, flexible in a horizontal plane, chemically resistant and impervious to salt water.

Those skilled in the art will recognize, or be able to ascertain using no more than routine experimentation, many equivalents to the specific embodiments of the invention described herein. Such equivalents are intended to be encompassed by the following claims. The following claims are provided to add additional clarity to this disclosure. Future applications claiming priority to this application may or may not include the following claims, and may include claims broader, narrower, or entirely different from the following claims.

What is claimed is:

1. A tactical belt comprising (a) an integral single layer first strap having a two opposite ends, a front face, a back face opposite to the front face, a top edge and a bottom edge, and a single row of a plurality of openings distributed horizontally and lengthwise along the strap between the two opposite ends, the openings being separated by links that are an integral part of the single layer first strap, and (b) a second strap having two opposite ends, a second strap top edge and a second strap bottom edge, each opposite end of the second strap being attached to the back face of the first strap and can be seen through the openings, the second strap being disposed such as leaving a space between the top edge of the first strap and the second strap top edge and a space between the bottom edge of the first strap and the second strap bottom edge, the openings being configured to facilitate attachment of a MOLLE-compatible accessory directly to each of the openings along a horizontal axis that extends lengthwise through the two opposite ends by weaving the MOLLE-compatible accessory through adjacent openings and without skipping any of the links between the adjacent openings to which the MOLLE-compatible accessory is directly attached to, and to facilitate attachment of the MOLLE-compatible accessory directly to each of the openings along a vertical axis that passes through each opening and is perpendicular to the horizontal axis by inserting the MOLLE-compatible accessory through the space between the first strap and the second strap and one of the plurality openings.

2. The tactical belt of claim 1, wherein the tactical belt further comprises at least one attachment point below a main horizontal plane of the strap and attachment points at either of the opposite ends of the strap.

3. The tactical belt of claim 1, wherein the tactical belt further comprises a belt weaved through the plurality of openings along the single row.

4. The tactical belt of claim 1, wherein the single layer strap is configured to remain rigid in a vertical plane, flexible in a horizontal plane, chemically resistant and impervious to salt water.

5. The tactical belt of claim 1, wherein the single layer strap is composed of a thermoplastic composite.

6. The tactical belt of claim 1, wherein the tactical belt further comprises one or more attachments and leg straps connected to the tactical belt by the one or more attachments.

7. The tactical belt of claim 1, wherein the tactical belt further comprises a belt laced between the first strap and the second strap and directly below all of the openings and all of the links.

8. The tactical belt of claim 1, wherein the tactical belt further comprises a protrusion extending from the bottom edge of tactical belt, said protrusion having a hole.

9. The tactical belt of claim 1, wherein the openings are configured to facilitate attachment of a MOLLE-compatible accessory directly to each opening along the vertical axis that passes through each opening and is perpendicular to the horizontal axis.

10. The tactical belt of claim 1, wherein the openings are square.

* * * * *